US007234183B2

(12) United States Patent
Elrod et al.

(10) Patent No.: US 7,234,183 B2
(45) Date of Patent: Jun. 26, 2007

(54) MULTIPLE CHAMBER FLUID PRESSURIZABLE MATTRESS

(75) Inventors: Gary Michael Elrod Elrod, Summerville, SC (US); Richard Alan Feingold, Lake Bluff, IL (US)

(73) Assignee: Rapid Air LLC, Brookfield, WI (US)

( * ) Notice: Subject to any disclaimer, the term of this patent is extended or adjusted under 35 U.S.C. 154(b) by 142 days.

(21) Appl. No.: 11/053,020

(22) Filed: Feb. 8, 2005

(65) Prior Publication Data

US 2006/0174417 A1 Aug. 10, 2006

(51) Int. Cl.
*A47C 17/00* (2006.01)
*A47C 27/10* (2006.01)
*A47C 27/08* (2006.01)

(52) U.S. Cl. ..... 5/699; 5/710; 5/706

(58) Field of Classification Search ..... 5/709, 5/706, 710, 655.3, 644
See application file for complete search history.

(56) References Cited

U.S. PATENT DOCUMENTS

| | | | | |
|---|---|---|---|---|
| 2,743,510 | A | 5/1956 | Mauney | |
| 3,205,106 | A | 9/1965 | Cross | |
| 4,462,331 | A | 7/1984 | McCrory | |
| 4,829,616 | A | 5/1989 | Walker | |
| 4,846,917 | A | 7/1989 | Hartel | |
| 4,890,344 | A | 1/1990 | Walker | |
| 4,906,502 | A | 3/1990 | Rudy | |
| 5,020,176 | A | 6/1991 | Dotson | |
| 5,083,361 | A | 1/1992 | Rudy | |
| 5,152,018 | A | 10/1992 | Lea | |
| 5,509,154 | A | 4/1996 | Shafer et al. | |
| 5,595,806 | A * | 1/1997 | Korfmacher | 428/69 |
| 5,642,546 | A | 7/1997 | Shoenhair | |
| 5,652,484 | A | 7/1997 | Shafer et al. | |
| 5,765,246 | A | 6/1998 | Shoenhair | |
| 5,903,941 | A | 5/1999 | Shafer et al. | |
| 6,037,723 | A | 3/2000 | Shafer et al. | |
| 6,076,214 | A * | 6/2000 | Klimenko | 5/710 |
| 6,119,371 | A | 9/2000 | Goodwin | |
| 6,202,239 | B1 | 3/2001 | Ward et al. | |
| 6,260,222 | B1 * | 7/2001 | Lin | 5/709 |
| 6,397,419 | B1 | 6/2002 | Mechache | |
| 6,483,264 | B1 | 11/2002 | Shafer et al. | |
| 6,708,357 | B2 | 3/2004 | Gaboury et al. | |
| 2005/0204457 | A1 | 9/2005 | Schmitz et al. | |

* cited by examiner

*Primary Examiner*—Patricia Engle
*Assistant Examiner*—Jonathan Liu
(74) *Attorney, Agent, or Firm*—Brian G. Gilpin; Godfrey & Kahn, S.C.

(57) ABSTRACT

The present invention comprises a fluid pressurizable multiple chamber mattress wherein each chamber is capable of operably receiving and releasing a fluid, comprising a first covering sheet, at least two fabric layers positioned upon the inner surface of the first covering sheet, the inner surfaces of the fabric layers being linked via a plurality of threads, a second covering sheet, a first dielectric weld forming a first and a second fluid pressurizable chamber defined between the outer surfaces of the fabric layers and the inner surfaces of the first and second covering sheets, a second dielectric weld, forming a third fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

44 Claims, 3 Drawing Sheets

MULTIPLE CHAMBER FLUID PRESSURIZABLE MATTRESS

BACKGROUND

The present invention relates to a fluid pressurizable multiple chamber mattress wherein each chamber is capable of operably receiving and releasing a fluid.

Fluid pressurizable mattreses are typically used as an alternative to the traditional foam and inner spring mattress. Air mattresses as a direct replacement of the traditional mattress and may or may not be positioned upon a mattress foundation. Air mattresses typically only have a single fluid pressurizable chamber bounded by a top and bottom layer with an internal support structure therebetween. A recent development in the air mattress industry has been the introduction of systems which allow the user to control the amount of air pressure delivered to and maintained within the mattress, which corresponds to a user selected adjustable firmness control.

A problem in the air mattress industry is providing and maintaining perfectly flat air holding sleep surfaces. Previous air holding mattresses have depended upon internal, separately attached support members to attempt to hold the structure in a desired form. Typically this involved the use of numerous I-beam shaped support structures spaced at intervals and connecting the top and bottom layers of the structure. While at the point of connection between the I-beam and the top and bottom sheet, the structure is typically held in the desired flat form, the interval between I-beam is not, and under pressure, this portion of the structure assumes a raised curvilinear shape that is repeated across the structure.

Furthermore, the I-beam construction method is not reliable. The points at which the I-beam shaped support structures are connected to the top and bottom layers are highly stressed when the structure is placed and maintained under pressure. Over time the force of the structure's internal pressure, and the resultant over pressurization upon compression of the structure by a user, "peels" or "tears" the I-beam support away from the top and bottom layers, comprising an inherent failure point.

Upon failure of the internal support structure, another disadvantage of the prior air mattress is revealed: the tendency to "hammock". When the internal supports fail, regardless of the air pressure within the structure, the mattress (especially under the pressure of a user) will "hammock", meaning that the surface will form a concave depression. This tendency is directly related to the use of only a single air holding chamber and the weak internal support of the mattress structure.

What is needed, therefore, is multiple chamber an fluid holding mattress that can be easily and reliably manufactured to provide and maintain a perfectly flat fluid holding sleep surface.

SUMMARY

The present invention is directed to a fluid pressurizable multiple chamber mattress wherein each chamber is capable of operably receiving and releasing a fluid. The fluid pressurizable chamber comprises a first fluid impermeable dielectrically weldable non-crystallizing hydrocarbon covering sheet having an inner surface and an outer surface; at least two fabric layers positioned upon the inner surface of the first covering sheet, the fabric layers having an outer surface and an inner surface, the inner surfaces of the fabric layers being linked via a plurality of threads, the outer surfaces of the fabric layers carrying an fluid impermeable dielectrically weldable non-crystallizing hydrocarbon coating, wherein at least one coated outer fabric surface is in contact with the inner surface of the first covering sheet; a second fluid impermeable dielectrically weldable non-crystallizing hydrocarbon covering sheet having an inner surface and an outer surface, the second covering sheet positioned onto the first covering sheet and the fabric layers, wherein at least one coated outer fabric surface is in contact with the inner surface of the second covering sheet, wherein the inner surfaces of the first and second covering sheets contact; a first dielectric weld, welding the inner surfaces of the first and second covering sheets to the outer surfaces of the fabric layers forming a first and a second fluid impermeable fluid pressurizable chamber defined between the outer surfaces of the fabric layers and the inner surfaces of the first and second covering sheets; a second dielectric weld, welding the inner surfaces of the first and second covering sheets forming a third fluid impermeable fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

The preferred method of constructing the a fluid pressurizable multiple chamber mattress of the present invention wherein each chamber is capable of operably receiving and releasing a fluid, comprises the steps of providing a first fluid impermeable dielectrically weldable non-crystallizing hydrocarbon covering sheet having an inner surface and an outer surface; positioning upon the inner surface of the first covering sheet at least two fabric layers having an outer surface and an inner surface, the inner surfaces of the fabric layers being linked via a plurality of threads, the outer surfaces of the fabric layers carrying an fluid impermeable dielectrically weldable non-crystallizing hydrocarbon coating; placing at least one coated outer fabric surface in contact with the first covering sheet inner surface; providing a second fluid impermeable dielectrically weldable non-crystallizing hydrocarbon covering sheet having an inner surface and an outer surface; positioning, the second covering sheet onto the first covering sheet and fabric layers; placing at least one coated outer fabric surface in contact with the second covering sheet inner surface; placing the first and second covering sheet inner surfaces in contact beyond a perimeter of the fabric layers; forming a first dielectric weld, wherein the first and second covering sheets are welded to the fabric layers; forming a first and a second fluid impermeable fluid pressurizable chamber defined between the outer surfaces of the fabric layers and the inner surfaces of the first and second covering sheets; forming a second dielectric weld, wherein the inner surfaces of the first and second covering sheets in contact beyond a perimeter of the fabric layers are welded; forming a third fluid impermeable fluid pressurizable chamber defined between the inner surfaces of the first and second covering sheets and the inner surfaces of the fabric layers; and placing at least one fluid valve in at least one covering sheet for operably pressurizing and depressurizing at least one fluid pressurizable chamber.

DETAILED DESCRIPTION

Fluid: having particles that easily move and change their relative position without a separation of the mass and that easily yield to pressure.

Chamber: enclosed space or cavity.

Mattress: used either alone as a bed or on a bedstead.

Cushion: a soft pillow or pad usually used for sitting, reclining, or kneeling.

Fluid Impermeable: not permitting passage of a fluid (as of a gas) through its substance.

Dielectric Welding: sometimes known as Radio Frequency (RF) welding or High Frequency (HF) welding, is the process of fusing materials together by applying radio frequency energy to the area to be joined.

Dielectrically Weldable: capable of being fused by applying radio frequency energy.

Welding: to unite by heating and allowing the materials to flow together or by hammering or compressing with or without previous heating.

Bonding: to cause to adhere firmly.

Pressurized: to confine the contents of under a pressure greater than that of the outside atmosphere.

Figure 1:
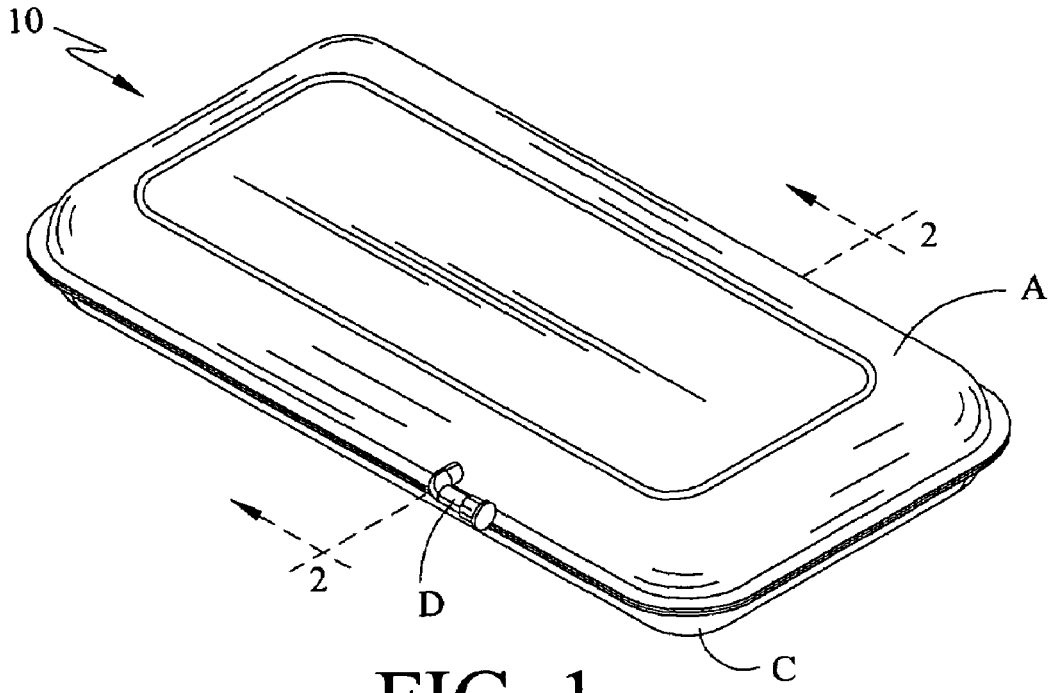
FIG. 1 is a perspective view illustrating a multiple chamber fluid pressurizable mattress constructed in accordance with the present invention.

Referring to the Drawings, wherein like numbers indicate like elements, there is illustrated in FIG. 1, a multiple chamber fluid pressurizable mattress constructed in accordance with the present invention, generally indicated at 10. The fluid pressurizable chamber 10, includes a first covering sheet A, fabric layers B, a second covering sheet C, and a fluid valve D. The mattress comprises three independently fluid pressurizable chambers.

First covering sheet A and second covering sheet C preferably are constructed of the same thermoplastic material, preferably dielectrically weldable non-crystallizing hydrocarbons, such as Polyvinylchlorides (PVC), Polyurethanes, Thermoplastic Polyurethanes (TPU), Nylons, Polyethylene Terepthalates (PET), Ethylene Vinyl Acetates (EVA), and Acrylonitrile Butadiene Styrenes (ABS).

FIG. 1 illustrates the first covering sheet A and second covering sheet C integrally formed together by a process in accordance with the present invention, which will be described in detail hereafter. First covering sheet A and second covering sheet C are generally flat, each having an inner surface and an outer surface, respectively.

Figure 2:
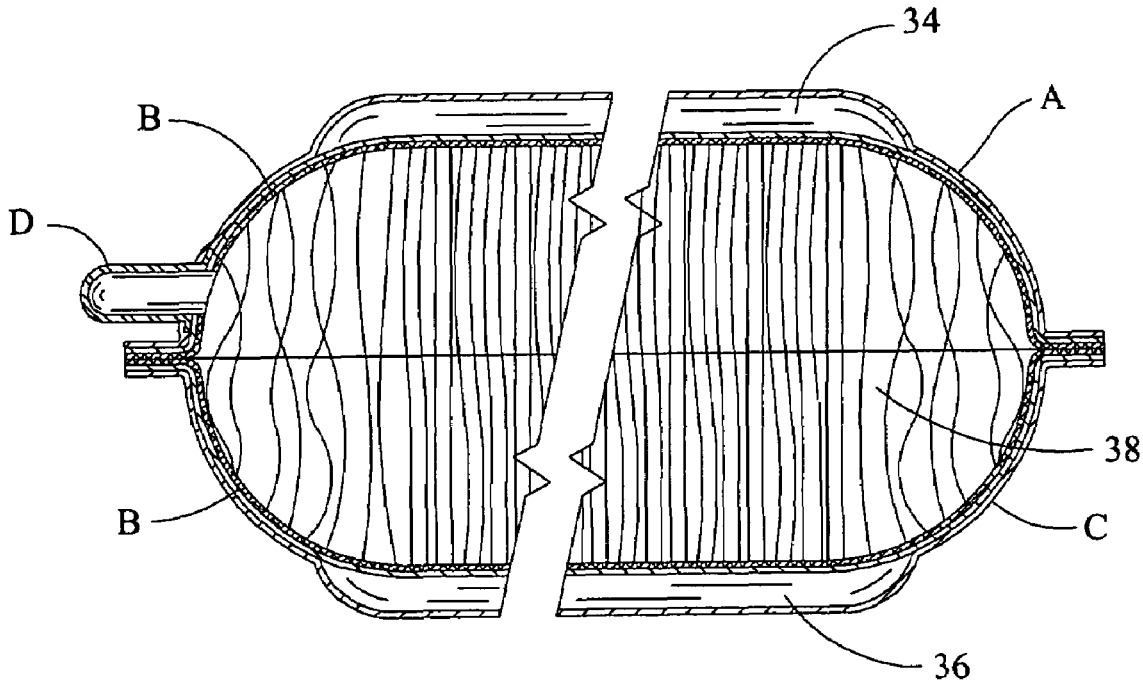
FIG. 2 is a cross sectional view taken generally along line 2-2 of FIG. 1, illustrating the internal construction and orientation of the multiple fluid pressurizable chambers in accordance with the present invention.

Fabric layers B, illustrated at FIG. 2, are a double-walled fabric preferably formed from at least a first fabric layer having inner surface and an outer surface, and a second fabric layer having an inner surface and an outer surface. The inner surfaces of the first and second fabric layers are linked via a plurality of threads 22. The threads 22 may be of a natural or synthetic construction. The threads may be infinitely short or infinitely long in length and may be dispersed about the fabric in equally infinite densities per square inch.

The outer surfaces of the first and second fabric layers are preferably coated to assist in forming a strong bond with the first covering sheet A and second covering sheet C. The coating is preferably of the same thermoplastic materials forming the covering sheets, preferably dielectrically weldable non-crystallizing hydrocarbons, such as Polyvinylchlorides (PVC), Polyamides (PA), Polyurethanes, Thermoplastic Polyurethanes (TPU), Nylon Polyethylene Terepthalates (PET), Ethylene Vinyl Acetates (EVA), and Acrylonitrile Butadiene Styrenes (ABS). The coating may be applied via any coating method, such as spraying, rolling, dipping or foaming.

Figure 3:
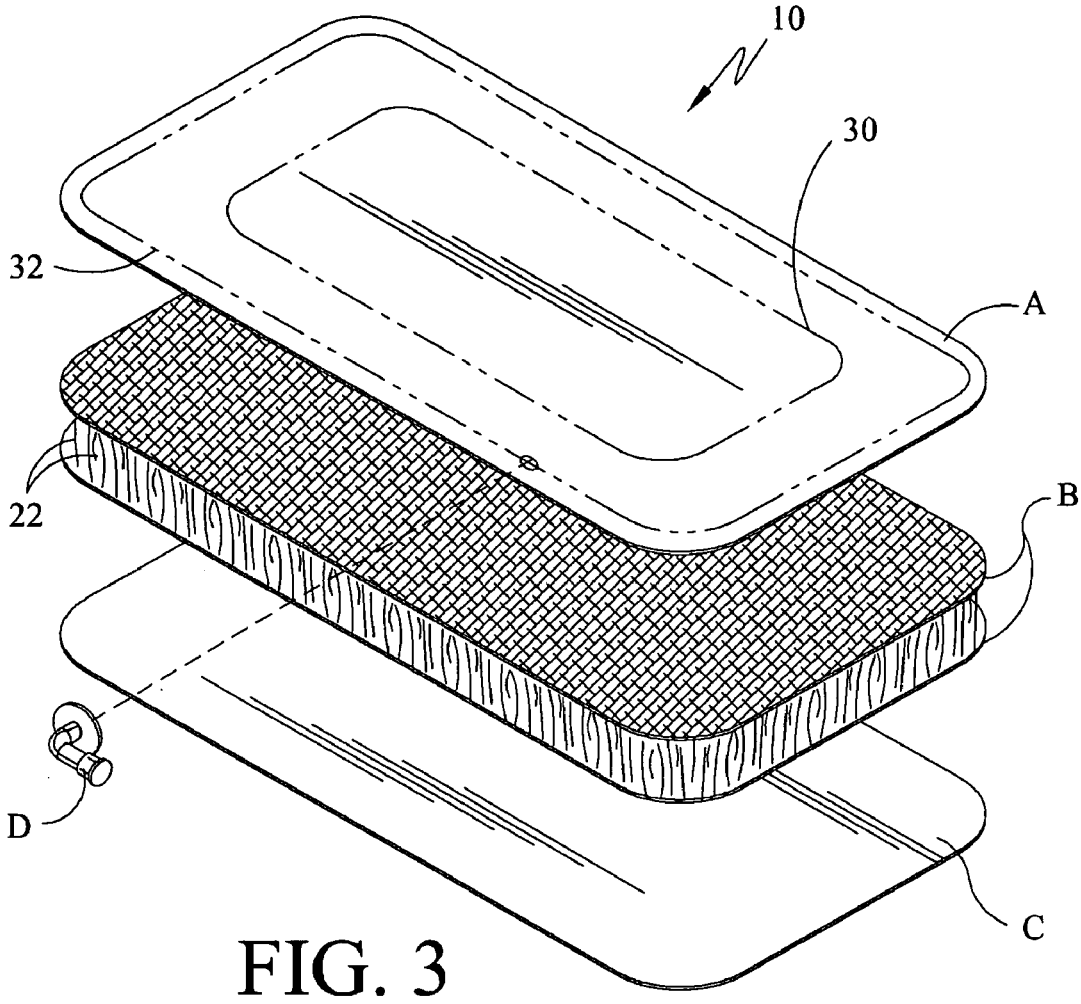
FIG. 3 is an exploded perspective view illustrating the components comprising the multiple chamber fluid pressurizable mattress constructed in accordance with the present invention.
Figure 4:
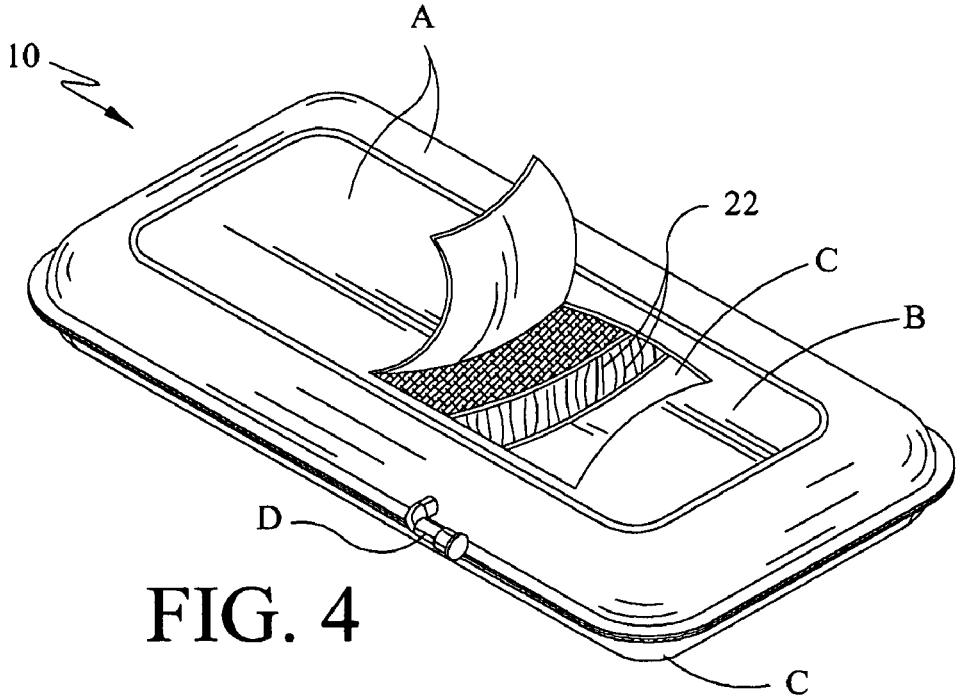
FIG. 4 is a partial cross sectional view illustrating the construction and orientation of the components comprising the multiple chamber fluid pressurizable mattress constructed in accordance with the present invention.
Figure 5:
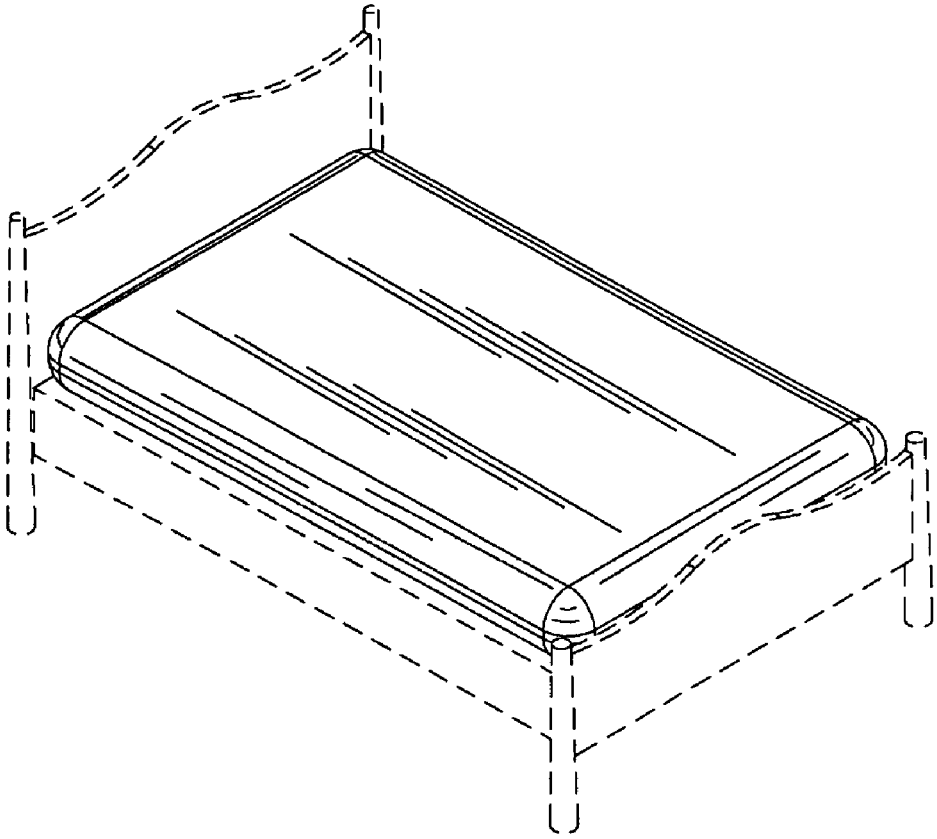
FIG. 5 is a perspective view illustrating a multiple chamber pressurizable mattress constructed in accordance with the invention employed as a sleeping surface.
Figure 6:
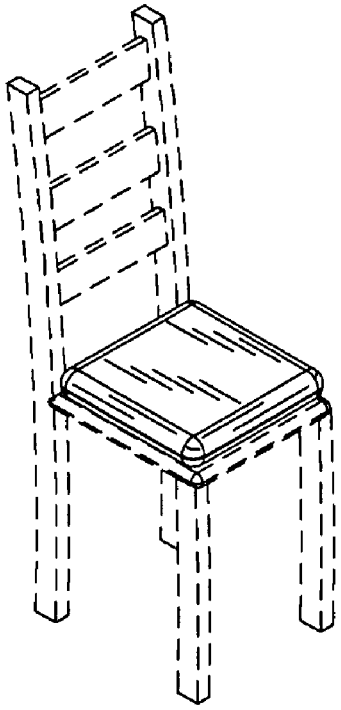
FIG. 6 is a perspective view illustrating a multiple chamber pressurizable mattress constructed in accordance with the invention employed as a seating surface.

FIG. 3 diagrammatically illustrates the apparatus and process for forming the multiple chamber fluid pressurizable mattress of the present invention. The inner surfaces of the first covering sheet A and second covering sheet C are bonded 30 to the outer surfaces of the first fabric layer and second fabric layer forming a first fluid pressurizable chamber 34 and a second fluid pressurizable chamber 36. The first fluid pressurizable chamber 34 and a second fluid pressurizable chamber 36 are defined between the outer surfaces of the fabric layers and the inner surfaces of the first and second covering sheets The inner surfaces of the first covering sheet A and second covering sheet C are bonded 32, forming a third fluid pressurizable chamber 38. The third fluid pressurizable chamber 38 is defined between the inner surfaces of the first and second covering sheets and the inner surfaces of the fabric layers.

Preferably the bonding is accomplished by dielectric welding. Dielectric welding, sometimes referred to as radio frequency (RF) welding or high frequency (HF) welding, is the process of bonding materials together by applying radio frequency energy to the area to be joined. Dielectric welding uses a high frequency radio signal to create molecular motion within a polymer that is polar in nature. Generally, the polymers are placed between two electrodes that are connected to a radio frequency generator. The two electrodes are oppositely charged, one negative, one positive. The charges of the electrodes are switched at a frequency dependant upon the RF generator and the polymer type. The polymers heat up from the friction between molecules as they alternate with the changing electromagnetic filed. At high frequencies, the polar molecules cannot align instantaneously, resulting in increased internal friction that produces enough heat to weld the material. The weld that results from dielectric welding is often as strong as the base material itself.

FIG. 3 illustrates the manner in which an assembly of first covering sheet A, fabric layers B, and second covering sheet C, are put together. The preferred method of manufacture comprises providing a first fluid impermeable covering sheet A having an inner surface and an outer surface. At least two fabric layers B have an outer surface and an inner surface, the inner surfaces of the fabric layers being linked via a plurality of threads 22 are positioned upon the inner surface of the first covering sheet A. At least one outer fabric surface is placed in contact with the inner surface of the first covering sheet. A second fluid impermeable covering sheet is provided, also having an inner surface and an outer surface. The second covering sheet is positioned onto the first covering sheet and fabric layers, placing at least one outer fabric surface in contact with the inner surface of the second covering sheet. The first and second covering sheet inner surfaces are preferably placed in contact beyond a perimeter of the fabric layers.

A first bond 30 is formed, wherein the first and second covering sheets are bonded to the fabric layers, forming a first 34 and a second 36 fluid impermeable fluid pressurizable chamber defined between the outer surfaces of the fabric layers and the inner surfaces of the first and second covering sheets. A second bond 32 is formed, wherein the inner surfaces of the first and second covering sheets in contact beyond a perimeter of the fabric layers are bonded forming a third fluid impermeable fluid pressurizable chamber 38 defined between the inner surfaces of the first and second covering sheets and the inner surfaces of the fabric layers. At least one fluid valve is placed in at least one covering sheet for operably pressurizing and depressurizing at least one of the fluid pressurizable chambers.

The plurality of threads 22 linking the inner surfaces of the first and second fabric layers controls the inflated height of the third fluid impermeable fluid pressurizable chamber 38. The chamber can only inflate to the predetermined length of the connecting threads. Fluid physics dictate that all inflated structures (under a field of gravity) will attempt to form a sphere. Attachment points between the walls of an inflated structure contain these physical stresses, and work to reform the structure into a desired form. Traditionally, these attachment points have been circles of material welded to top and bottom sheets, or flat pieces of material welded in similar fashion. The space between these attachment points allows the surface structure to pillow outward as the pressure is increased within the chamber. The plurality of threads 22 linking the inner surfaces of the first and second fabric layers comprise attachment points into the wall material of the chamber, not as an added structure. This provides for a smooth, flat top and bottom surface for the fluid pressurizable mattress constructed in accordance with the invention. The only path of expansion or distortion extends outward at the sides of the mattress.

Thus, the use of a plurality of threads 22 linking the inner surfaces of the first and second fabric layers and comprising attachment points is critical to producing a fluid pressurizable air mattress having a perfectly smooth, flat top and bottom surface. Another advantage of utilizing a plurality of threads is that should a single (or multiple) thread fiber fail, it does not compromise the air holding ability of the mattress chamber.

Numerous characteristics and advantages of the invention have been described in detail in the foregoing description with reference to the accompanying drawings. However, the disclosure is illustrative only and the invention is not limited to the precise illustrated embodiment. Various changes and modifications may be effected therein by persons skilled in the art without departing from the scope or spirit of the invention.

What is claimed is:

1. A fluid pressurizable multiple chamber mattress wherein each chamber is capable of operably receiving and releasing a fluid, comprising:

a first fluid impermeable dielectrically weldable non-crystallizing hydrocarbon covering sheet having an inner surface and an outer surface;

at least two fabric layers wherein at least one layer is positioned upon the inner surface of the first covering sheet, the fabric layers having an outer surface and an inner surface, the inner surfaces of the fabric layers being linked via a plurality of threads, the outer surfaces of the fabric layers carrying an fluid impermeable dielectrically weldable non-crystallizing hydrocarbon coating, wherein at least one coated outer fabric surface is in contact with the inner surface of the first covering sheet;

a second fluid impermeable dielectrically weldable non-crystallizing hydrocarbon covering sheet having an inner surface and an outer surface, the second covering sheet positioned onto the first covering sheet and the fabric layers, wherein at least one coated outer fabric surface is in contact with the inner surface of the second covering sheet, wherein the inner surfaces of the first and second covering sheets contact beyond a perimeter of the fabric layers;

a first dielectric weld, welding the inner surfaces of the first and second covering sheets to the outer surfaces of the fabric layers forming a first and a second fluid impermeable fluid pressurizable chamber defined between the outer surfaces of the fabric layers and the inner surfaces of the first and second covering sheets;

a second dielectric weld, welding the inner surfaces of the first and second covering sheets forming a third fluid impermeable fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

2. A fluid pressurizable multiple chamber mattress wherein at least one chamber is capable of operably receiving and releasing a fluid, comprising:

a first fluid impermeable dielectrically weldable covering sheet having an inner surface and an outer surface;

at least two fabric layers wherein at least one layer is positioned upon the inner surface of the first covering sheet, the fabric layers having an outer surface and an inner surface,the inner surfaces of the fabric layers being linked via a plurality of threads, the outer surfaces of the fabric layers carrying a fluid impermeable dielectrically weldable coating, wherein at least one coated outer fabric surface is in contact with the inner surface of the first covering sheet;

a second fluid impermeable dielectrically weldable covering sheet having an inner surface and an outer surface, the second covering sheet positioned onto the first covering sheet and the fabric layers, wherein at least one coated outer fabric surface is in contact with the inner surface of the second covering sheet, wherein the inner surfaces of the first and second covering sheets contact beyond a perimeter of the fabric layers;

a first dielectric weld, welding the inner surfaces of the first and second covering sheets to the outer surfaces of the fabric layers forming a first and a second fluid impermeable fluid pressurizable chamber defined between the outer surfaces of the fabric layers and the inner surfaces of the first and second covering sheets;

a second dielectric weld, welding the inner surfaces of the first and second covering sheets forming a third fluid impermeable fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

3. A fluid pressurizable mattress capable of operably receiving and releasing a fluid, comprising:

a first fluid impermeable covering sheet having an inner surface and an outer surface; at least two fabric layers wherein at least one layer is positioned upon the inner surface of the first covering sheet, the fabric layers having an outer surface and an inner surface, the inner surfaces of the fabric layers being linked via a plurality of threads, the outer surfaces of the fabric layers carrying a fluid impermeable coating, wherein at least one coated outer fabric surface is in contact with the inner surface of the first covering sheet;

a second fluid impermeable covering sheet having an inner surface and an outer surface, the second covering sheet positioned onto the first covering sheet and the fabric layers, wherein at least one coated outer fabric surface is in contact with the inner surface of the second covering sheet, wherein the inner surfaces of the first and second covering sheets contact beyond a perimeter of the fabric layers;

a first bond, bonding the inner surfaces of the first and second covering sheets to the outer surfaces of the fabric layers forming a first and a second fluid impermeable fluid pressurizable chamber defined between the outer surfaces of the fabric layers and the inner surfaces of the first and second covering sheets;

a second bond, bonding the inner surfaces of the first and second covering sheets forming a third fluid impermeable fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

4. A fluid pressurizable chamber, comprising:

a first fluid impermeable covering sheet having an inner surface and an outer surface;

at least two fabric layers wherein at least one layer is positioned upon the inner surface of the first covering sheet, the fabric layers having an outer surface and an inner surface, the inner surfaces of the fabric layers being linked via a plurality of threads, the outer surfaces of the fabric layers carrying a fluid impermeable coating, wherein at least one outer fabric surface is in contact with the inner surface of the first covering sheet;

a second fluid impermeable covering sheet having an inner surface and an outer surface, the second covering sheet positioned onto the first covering sheet and the fabric layers, wherein at least one outer fabric surface is in contact with the inner surface of the second covering sheet, wherein the inner surfaces of the first and second covering sheets contact beyond a perimeter of the fabric layers;

a first bond, bonding the inner surfaces of the first and second covering sheets to the outer surfaces of the fabric layers forming a first and a second fluid impermeable fluid pressurizable chamber defined between the outer surfaces of the fabric layers and the inner surfaces of the first and second covering sheets;

a second bond, bonding the inner surfaces of the first and second covering sheets forming a third fluid impermeable fluid pressurizable chamber defined between the inner surfaces of the first and second covering sheets and the inner surfaces of the fabric layers; and at least one fluid valve carried by at least one covering sheet for permitting the pressurization and depressurization of at least one fluid pressurizable chamber.

5. The fluid pressurizable chamber of claim 4, wherein the first fluid impermeable covering sheet is dielectrically weldable.

6. The fluid pressurizable chamber of claim 5, wherein the first fluid impermeable covering sheet comprises non-crystallizing hydrocarbons.

7. The fluid pressurizable chamber of claim 4, wherein the first fluid impermeable covering sheet is selected from the group consisting of polyvinylchloride, polyurethane, thermoplastic polyurethane, nylon, polyethylene terephthalate, ethylene vinyl acetate, and acrylonitrile butadiene styrene.

8. The fluid pressurizable chamber of claim 4, wherein the outer surfaces of the fabric layers carry a fluid impermeable coating.

9. The fluid pressurizable chamber of claim 8, wherein the fluid impermeable coating is dielectrically weldable.

10. The fluid pressurizable chamber of claim 9, wherein the fluid impermeable dielectrically weldable coating comprises non-crystallizing hydrocarbons.

11. The fluid pressurizable chamber of claim 8, wherein the fluid impermeable dielectrically weldable coating is selected from the group consisting of polyvinylchloride, polyurethane, thermoplastic polyurethane, nylon, polyethylene terephthalate, ethylene vinyl acetate, and acrylonitrile butadiene styrene.

12. The fluid pressurizable chamber of claim 8, wherein at least one coated outer fabric surface is in contact with the inner surface of the first covering sheet.

13. The fluid pressurizable chamber of claim 8, wherein at least one coated outer fabric surface is in contact with the inner surface of the second covering sheet.

14. The fluid pressurizable chamber of claim 4, wherein the threads comprise a length from 1 to 12 inches.

15. The fluid pressurizable chamber of claim 4, wherein the threads comprise a density from 1 to 50 threads per square inch.

16. The fluid pressurizable chamber of claim 4, wherein the second fluid impermeable covering sheet is dielectrically weldable.

17. The fluid pressurizable chamber of claim 16, wherein the second fluid impermeable covering sheet comprises non-crystallizing hydrocarbons.

18. The fluid pressurizable chamber of claim 4, wherein the second fluid impermeable covering sheet is selected from the group consisting of polyvinylchloride, polyurethane, thermoplastic polyurethane, nylon, polyethylene terephthalate, ethylene vinyl acetate, and acrylonitrile butadiene styrene.

19. The fluid pressurizable chamber of claim 4, wherein the first bond comprises a dielectric weld.

20. The fluid pressurizable chamber of claim 4, wherein the first bond comprises an adhesive.

21. The fluid pressurizable chamber of claim 4, wherein the second bond comprises a dielectric weld.

22. The fluid pressurizable chamber of claim 4, wherein the second bond comprises an adhesive.

23. A method for manufacturing a fluid pressurizable multiple chamber mattress wherein each chamber is capable of operably receiving and releasing a fluid, comprising the steps of:

providing a first fluid impermeable dielectrically weldable non-crystallizing hydrocarbon covering sheet having an inner surface and an outer surface;

positioning upon the inner surface of the first covering sheet at least two fabric layers having an outer surface and an inner surface, the inner surfaces of the fabric layers being linked via a plurality of threads, the outer surfaces of the fabric layers carrying an fluid impermeable dielectrically weldable non-crystallizing hydrocarbon coating;

placing at least one coated outer fabric surface in contact with the first covering sheet inner surface;

providing a second fluid impermeable dielectrically weldable non-crystallizing hydrocarbon covering sheet having an inner surface and an outer surface;

positioning, the second covering sheet onto the first covering sheet and fabric layers;

placing at least one coated outer fabric surface in contact with the second covering sheet inner surface;

placing the first and second covering sheet inner surfaces in contact beyond a perimeter of the fabric layers;

forming a first dielectric weld, wherein the first and second covering sheets are welded to the fabric layers;

forming a first and a second fluid impermeable fluid pressurizable chamber defined between the outer surfaces of the fabric layers and the inner surfaces of the first and second covering sheets;

forming a second dielectric weld, wherein the inner surfaces of the first and second covering sheets in contact beyond a perimeter of the fabric layers are welded;

forming a third fluid impermeable fluid pressurizable chamber defined between the inner surfaces of the first and second covering sheets and the inner surfaces of the fabric layers; and placing at least one fluid valve in at least one covering sheet for operably pressurizing and depressurizing at least one fluid pressurizable chamber.

24. A method for manufacturing a fluid pressurizable multiple chamber mattress wherein at least one chamber is capable of operably receiving and releasing a fluid, comprising the steps of:

providing a first fluid impermeable dielectrically weldable covering sheet having an inner surface and an outer surface;

positioning upon the inner surface of the first covering sheet at least two fabric layers having an outer surface and an inner surface, the inner surfaces of the fabric layers being linked via a plurality of threads, the outer surfaces of the fabric layers carrying an fluid impermeable dielectrically weldable coating;

placing at least one coated outer fabric surface in contact with the first covering sheet inner surface;

providing a second fluid impermeable dielectrically weldable covering sheet having an inner surface and an outer surface;

positioning, the second covering sheet onto the first covering sheet and fabric layers;

placing at least one coated outer fabric surface in contact with the second covering sheet inner surface;

placing the first and second covering sheet inner surfaces in contact beyond a perimeter of the fabric layers; forming a first dielectric weld, wherein the first and second covering sheets are welded to the fabric layers;

forming a first and a second fluid impermeable fluid pressurizable chamber defined between the outer surfaces of the fabric layers and the inner surfaces of the first and second covering sheets; forming a second dielectric weld, wherein the inner surfaces of the first and second covering sheets in contact beyond a perimeter of the fabric layers are welded;

forming a third fluid impermeable fluid pressurizable chamber defined between the inner surfaces of the first and second covering sheets and the inner surfaces of the fabric layers; and placing at least one fluid valve in at least one covering sheet for operably pressurizing and depressurizing at least one fluid pressurizable chamber.

25. A method for manufacturing a fluid pressurizable mattress capable of operably receiving and releasing a fluid, comprising the steps of:

providing a first fluid impermeable covering sheet having an inner surface and an outer surface;

positioning upon the inner surface of the first covering sheet at least two fabric layers having an outer surface and an inner surface, the inner surfaces of the fabric layers being linked via a plurality of threads, the outer surfaces of the fabric layers carrying an fluid impermeable coating;

placing at least one coated outer fabric surface in contact with the first covering sheet inner surface; providing a second fluid impermeable covering sheet having an inner surface and an outer surface;

positioning, the second covering sheet onto the first covering sheet and fabric layers;

placing at least one coated outer fabric surface in contact with the second covering sheet inner surface;

placing the first and second covering sheet inner surfaces in contact beyond a perimeter of the fabric layers;

forming a first bond, wherein the first and second covering sheets are bonded to the fabric layers;

forming a first and a second fluid impermeable fluid pressurizable chamber defined between the outer surfaces of the fabric layers and the inner surfaces of the first and second covering sheets;

forming a second bond, wherein the inner surfaces of the first and second covering sheets in contact beyond a perimeter of the fabric layers are bonded;

forming a third fluid impermeable fluid pressurizable chamber defined between the inner surfaces of the first and second covering sheets and the inner surfaces of the fabric layers; and placing at least one fluid valve in at least one covering sheet for operably pressurizing and depressurizing at least one fluid pressurizable chamber.

26. A method for manufacturing a fluid pressurizable chamber, comprising the steps of:

providing a first fluid impermeable covering sheet having an inner surface and an outer surface;

positioning upon the inner surface of the first covering sheet at least two fabric layers having an outer surface and an inner surface, the inner surfaces of the fabric layers being linked via a plurality of threads, the outer surfaces of the fabric layers carrying an fluid impermeable coating;

placing at least one outer fabric surface in contact with the first covering sheet inner surface; providing a second fluid impermeable covering sheet having an inner surface and an outer surface;

positioning, the second covering sheet onto the first covering sheet and fabric layers;

placing at least one outer fabric surface in contact with the second covering sheet inner surface;

placing the first and second covering sheet inner surfaces in contact beyond a perimeter of the fabric layers;

forming a first bond, wherein the first and second covering sheets are bonded to the fabric layers;

forming a first and a second fluid impermeable fluid pressurizable chamber defined between the outer surfaces of the fabric layers and the inner surfaces of the first and second covering sheets;

forming a second bond, wherein the inner surfaces of the first and second covering sheets in contact beyond a perimeter of the fabric layers are bonded;

forming a third fluid impermeable fluid pressurizable chamber defined between the inner surfaces of the first and second covering sheets and the inner surfaces of the fabric layers; and placing at least one fluid valve in at least one covering sheet for operably pressurizing and depressurizing at least one fluid pressurizable chamber.

27. The method for manufacturing a fluid pressurizable chamber of claim 26, wherein the first fluid impermeable covering sheet is dielectrically weldable.

28. The method for manufacturing a fluid pressurizable chamber of claim 27, wherein the first fluid impermeable covering sheet comprises non-crystallizing hydrocarbons.

29. The method for manufacturing a fluid pressurizable chamber of claim 26, wherein the first fluid impermeable covering sheet is selected from the group consisting of polyvinylchloride, polyurethane, thermoplastic polyurethane, nylon, polyethylene terephthalate, ethylene vinyl acetate, and acrylonitrile butadiene styrene.

30. The method for manufacturing a fluid pressurizable chamber of claim 26, wherein the outer surfaces of the fabric layers carry an fluid impermeable coating.

31. The method for manufacturing a fluid pressurizable chamber of 30, wherein the fluid impermeable coating is dielectrically weldable.

32. The fluid pressurizable chamber of claim 31, wherein the fluid impermeable dielectrically weldable coating comprises non-crystallizing hydrocarbons.

33. The method for manufacturing a fluid pressurizable chamber of claim 30, wherein the fluid impermeable coating is selected from the group consisting of polyvinylchloride, polyurethane, thermoplastic polyurethane, nylon, polyethylene terephthalate, ethylene vinyl acetate, and acrylonitrile butadiene styrene.

34. The method for manufacturing a fluid pressurizable chamber of claim 30, wherein at least one coated outer fabric surface is in contact with the inner surface of the first covering sheet.

35. The method for manufacturing a fluid pressurizable chamber of claim 30, wherein at least one coated outer fabric surface is in contact with the inner surface of the second covering sheet.

36. The fluid pressurizable chamber of claim 26, wherein the threads comprise a length from 1 to 60 inches.

37. The fluid pressurizable chamber of claim 26, wherein the threads comprise a density from 1 to 50,000 threads per square inch.

38. The method for manufacturing a fluid pressurizable chamber of claim 26, wherein the second fluid impermeable covering sheet is dielectrically weldable.

39. The fluid pressurizable chamber of claim 38, wherein the second fluid impermeable covering sheet comprises non-crystallizing hydrocarbons.

40. The fluid pressurizable chamber of claim 26, wherein the second fluid impermeable covering sheet is selected from the group consisting of polyvinylchloride, polyurethane, thermoplastic polyurethane, nylon, polyethylene terephthalate, ethylene vinyl acetate, and acrylonitrile butadiene styrene.

41. The method for manufacturing a fluid pressurizable chamber of claim 26, wherein the first bond comprises a dielectric weld.

42. The method for manufacturing a fluid pressurizable chamber of claim 26, wherein the first bond comprises an adhesive.

43. The method for manufacturing a fluid pressurizable chamber of claim 26, wherein the second bond comprises a dielectric weld.

44. The method for manufacturing a fluid pressurizable chamber of claim 26, wherein the second bond comprises an adhesive.

* * * * *